US005512995A

United States Patent [19]

Gerbasi

[11] Patent Number: 5,512,995

[45] Date of Patent: Apr. 30, 1996

[54] NON-UNIFORM SCRAPER BLADE LOAD TO INCREASE DETONING ROLL LIFE

[75] Inventor: Dennis G. Gerbasi, Webster, N.Y.

[73] Assignee: Xerox Corporation, Stamford, Conn.

[21] Appl. No.: 293,971

[22] Filed: Aug. 22, 1994

[51] Int. Cl.[6] ..... G03G 21/00

[52] U.S. Cl. ..... 355/299; 355/296; 355/302

[58] Field of Search ..... 355/296, 297, 355/299, 301, 302; 15/256.5, 256.51

[56] References Cited

U.S. PATENT DOCUMENTS

| | | | |
|---|---|---|---|
| 4,247,196 | 1/1981 | Ogawa et al. | 355/299 |
| 4,819,026 | 4/1989 | Lange et al. | 355/302 X |
| 4,870,466 | 9/1989 | Iida | 355/297 |
| 4,989,047 | 1/1991 | Jugle et al. | 355/297 |
| 5,209,997 | 5/1993 | Fromm et al. | 430/99 |
| 5,212,530 | 5/1993 | Harada et al. | 355/301 |
| 5,229,817 | 7/1993 | Lange et al. | 355/296 X |
| 5,243,385 | 9/1993 | Thayer | 355/212 |
| 5,329,344 | 7/1994 | Gerbasi et al. | 355/301 |

*Primary Examiner*—Sandra L. Brase
*Attorney, Agent, or Firm*—T. L. Fair

[57] ABSTRACT

A cleaning apparatus for achieving a non-uniform load on the detoning roll to prolong the life of the detoning roll by preventing premature wear of the detoning roll ends. The uniform load on the scraper blade is prevented from wearing the detoning edges before the middle due to unequal toner distribution in the present invention. This results in a higher frictional force on the edges of the detoning roll than in the center. To prevent wearing of these edges, the ends of either the scraper blade or the scraper blade holder are angled away from the detoning roll enabling a desirable working load to be achieved at the center where sufficient toner can lubricate the blade edge without overloading the blade ends where toner collection is generally minimal. The present invention increases the scraper blade life and reduces detone roll wear without reducing cleaning performance.

14 Claims, 2 Drawing Sheets

NON-UNIFORM SCRAPER BLADE LOAD TO INCREASE DETONING ROLL LIFE

BACKGROUND OF THE INVENTION

This invention relates generally to a cleaning apparatus, and more particularly concerns adjusting the blade load on a detoning roll.

The scraper blade in present detoning roll cleaners supply a uniform load along the length of the detoning roll. The force from the blade scrapes the toner off the detoning roll. The wear of both the detoning roll and scraper blade are directly proportional to the load supplied by the scraper blade (i.e. the higher the load, the faster the wear rate on the detoning roll). The amount of toner applied between the roll and the scraper blade is inversely proportional to the wear rate. The more toner applied to the detoning roll, the better the lubrication between the detoning roll and the scraper blade resulting in a slower wear rate. However, the amount of toner at the ends of the detoning roll is less than the amount at the center because most images on the photoreceptor have higher densities in the middle than on the ends. This results in a higher frictional force on the ends of the detoning roll than in the center. Hence, the detoning roll has a faster wear rate on the ends causing the detoning roll ends to wear out before the middle. For detoning rolls with an anodized coating, the detoning roll wore until the anodized coating was thin enough that pin holes occurred on the surface of the roll. Thus, decreasing the efficiency and overall life of the roll.

A present solution, to uneven wear of the detoning roll, has been to compromise both performance and life of the detoning roll by slowing down the cleaner, to reduce the overall wear rate on the detoning roll and shortening the scraper blade to reduce the end wear on the detoning rolls.

The following disclosures may be relevant to various aspects of the present invention and may be briefly summarized as follows:

U.S. Pat. No. 5,243,385 to Thayer discloses a center portion of a backing photoreceptor support roll is proportionately bowed outward toward the cleaning blade to compensate for nonuniform belt tension under the blade cleaner due to the deflection of the backing support roll. This results in a uniform cleaning blade load and enhanced cleaning across a compliant belt photoreceptor having non-uniform belt tension, that is inexpensive and easy to manufacture and implement.

U.S. Pat. No. 5,209,997 to Fromm et al. discloses a three roll fuser including a fuser roll, pressure roll and a backup roll. The backup roll is crowned and is supported in pressure engagement with the fuser roll to form a first nip while the fuser roll is also supported in contact with the pressure roll. The pressure engagement of the crowned roll with the fuser roll eliminates nonuniform nip loading in wide fusers as well as providing uniform velocity through the fuser roll/pressure roll nip.

SUMMARY OF INVENTION

Briefly stated, and in accordance with one aspect of the present invention, there is provided an apparatus for removing particles from a surface. The apparatus comprises a blade having a free end in contact with the surface. The blade applies a non-uniform normal force on the surface, which compensates for a non-uniform coefficient of friction across the surface, to produce a substantial uniform frictional force on the surface preventing non-uniform wear along the surface.

Pursuant to another aspect of the present invention, there is provided an apparatus for removing particles from a surface. The apparatus comprising a housing, defining an open ended chamber. A brush, disposed in the chamber of the housing with a portion of the brush extending outwardly from the open end of the chamber of housing into engagement with the surface to remove particles therefrom. A detoning member for removing particles from the brush. And, a scraper blade having a free end in contact with the detoning member. The scraper blade applying a non-uniform normal force on the detoning member which compensates for a non-uniform coefficient of friction across the detoning member to produce a substantial uniform frictional force on the detoning member preventing non-uniform wear along the detoning member.

Pursuant to another aspect of the present invention, there is provided a method for removing particles from a surface, comprising the steps of: cleaning particles from the surface having a brush contacting the surface; detoning the brush having a detoning roll to remove particles from the brush; removing particles from the detoning roll with a scraper blade having a free end in contact with the detoning roll; supporting the scraper blade in a scraper blade holder; and applying a non-uniform normal force on the detoning roll which compensates for a non-uniform coefficient of friction across the detoning roll to produce a substantial uniform frictional force on the detoning roll preventing non-uniform wear along the detoning roll.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Reference is now made to the drawings where the showings are for the purpose of illustrating a preferred embodiment of the invention and not for limiting same.

Figure 1:
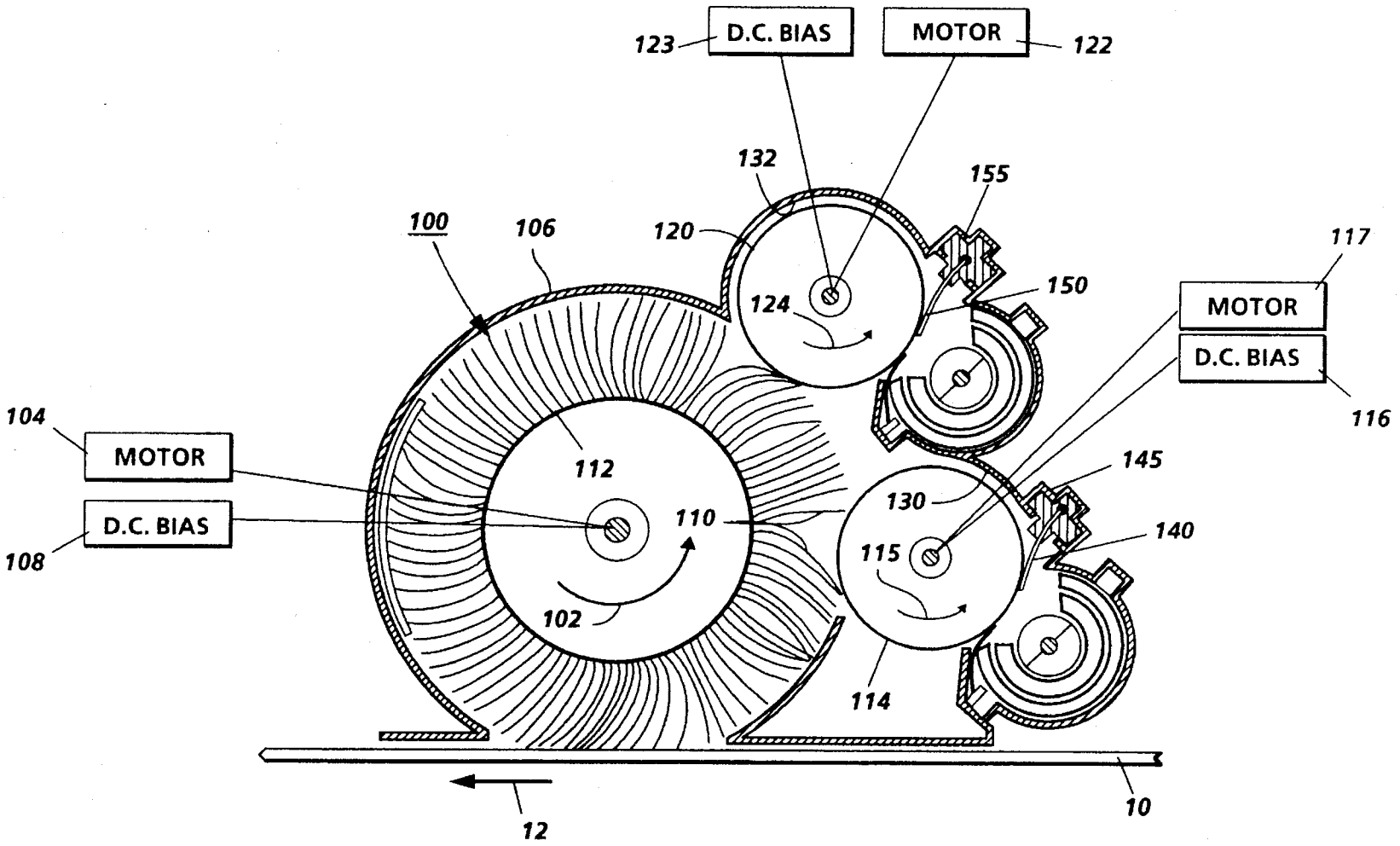
FIG. 1 is an elevational view of a cleaning apparatus for an electrophotographic printing machine.

Referring now to FIG. 1, a elevational illustration of the cleaning apparatus for an electrophotographic printer is shown. The apparatus includes a fiber brush cleaning arrangement having dual detoning rolls for removing residual toner and debris from the belt 10. (Although the embodiment described uses two detoning rolls on a brush, the present invention will also work with one detoning roll on a brush.) A fiber cleaning brush 100 is supported for rotational movement in the direction of the arrow 102 via motor 104, within a cleaning housing 106, and negatively biased by means of a D.C. power source 108. (The cleaning brush in FIG. 1 is shown as being biased, however, the present invention is also applicable to a mechanical cleaner brush.) As described in U.S. Pat. No. 3,572,923 to Fisher et al., a fiber brush may advantageously comprise a large number of conductive cleaning fibers 110 supported on a conductive cylindrical member 112. The housing 106 may be economically manufactured in a unitary extrusion, with recesses formed in accordance with component requirements. Residual toner and contaminants or debris such as paper fibers and Kaolin are removed from the photoreceptor belt 10 surface by means of a brushing action of the fibers 110 against belt 10 and the electrostatic charge applied to the fibers from the D.C. power supply 108. In a xerographic system of the type disclosed herein, brush 100 will remove both toner and debris from the photoreceptor, the former having a positive charge and the latter having a negative charge. Negatively charged contaminants are removed along with the positively charged toner particles to which they may be adhered.

The biased detoning rolls are located in adjacent proximity to the biased brush 100 to enable the detoning rolls 114, 120 to electrostatically remove the toner particles from the brush fibers 110. The brush fibers 110, of the illustrated embodiment, containing toner and debris removed from belt 10, rotating in the direction of arrow 12, are first contacted by a first detoning roll 114 supported for rotation in the direction of arrow 115, the same direction as brush 100, by means of a motor 117. An electrical bias is supplied to first detoning roll 114 from D.C. power supply 116. The detoning roll 114 is supported in a rotational position against brush 100, closely spaced to the position where brush fibers 110 leave contact with the surface of photoreceptor belt 10. A second detoning roll 120 is provided for further removal of the preponderance of residual toner from the brush at a location spaced along the circumference of the brush 100. A motor 122 drives the detoning roll 120 in the direction of the arrow 124, the same direction as fiber brush 100 and roll 114. An electrical bias is supplied to the detoning roll 120 from a D.C. power source 123. Recesses 130 and 132 in cleaning housing 106 are provided for the support of the detoning rolls 114 and 120, respectively therein. Within these recesses, and removed from cleaning brush 100, are located scraper blades 140, 150 for the detoning rolls 114, 120, respectively. The scraper blades 140, 150 remove the toner and debris particles from the surface of the detoning rolls 114,120 by a chiseling action when the blades 140, 150 are in the doctoring mode, as shown in FIG. 1. (The scraper blades can also remove the toner and debris particles from the detoning rolls by a wiping action, if the scraper blades are in the wiper mode.) The scraper blade is a metal material which includes stainless steel, aluminum, and carbon steels. The removed toner and debris particles fall into the auger arrangements and are transported to a storage area or to a developing station. Further structure associated with and operation of the detoning rolls 114, 120 are discussed in U.S. Pat. No. 4,829,026 to Lange et al., the pertinent portions of which are incorporated herein by reference.

The present invention improves efficiency and prolongs the life of the detoning rolls by making the wear rate the same along the ends of the detoning rolls 114,120 as it is in the middle. The amount of toner coming to the ends of the detoning roll can not be easily changed to increase lubrication thereon to decrease the wear rate, but, the blade scraper load can be reduced to prolong the life of the detoning roll. By decreasing the scraper load at the ends of the detoning roll, the wear rate will decrease and the life of the roll will increase. This decreased load at the detoning roll ends will not affect cleaning performance since there is less toner at the detoning roll ends.

Figure 2:
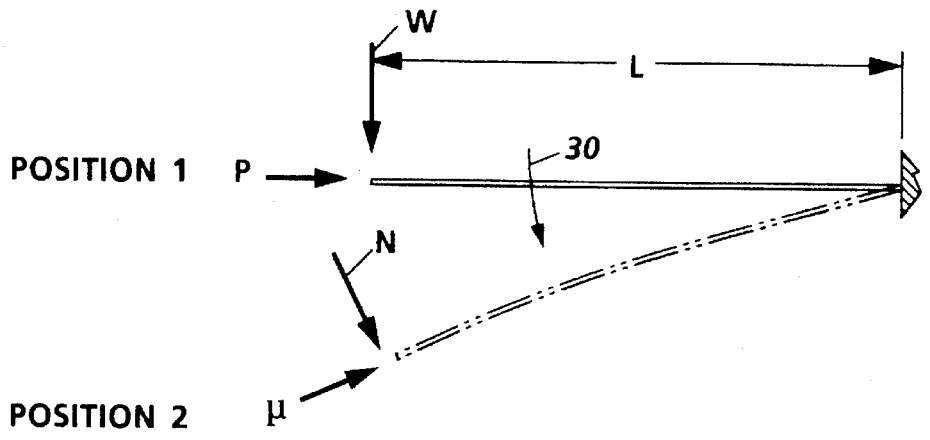
FIG. 2 is a schematic of a cantilever beam model for a blade contacting a detoning roll.

Reference is now made to FIG. 2, which depicts a cantilever beam model of the scraper blade, used to clean the detoning roll in the present invention. The extension length (L), is the length of the scraper blade extending from the scraper blade holder to the free end of the scraper blade. In position 1 of the model, the free end of the extension length, L, is not in contact with the detoning roll. On this free end of L, a transverse load, W, and an axial load, P, are present as shown. The axial load, P, is applied along the axis of the cantilever beam. The scraper blade extension length, L, frictionally contacts the detoning roll with its free end, as the scraper blade is slidably inserted into the blade holder, moving the scraper blade extension from position 1 to position 2, as shown by arrow 30. Position 2 depicts the free end of the scraper blade extension (L) with a normal force, N, and a frictional force, $\mu$, thereon. The deflected extension (L) is slightly bowed (as shown in position 2) due to the resistance caused by the detoning roll as the scraper blade extension contacts the detoning roll to clean the surface of the detoning roll.

Figure 3:
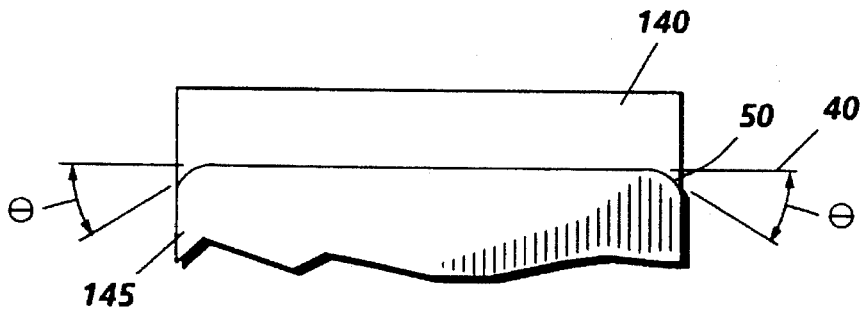
FIG. 3 is a schematic of one embodiment of the present invention with the blade holder "crowned"
Figure 4:
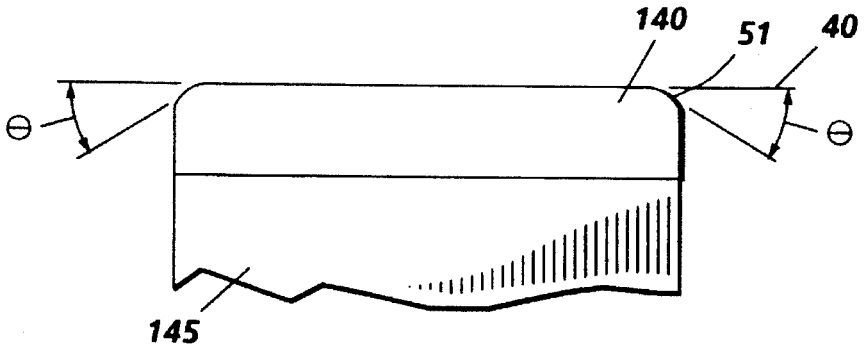
FIG. 4 is a schematic of an alternate embodiment of the present invention with the blade "crowned".

Reference is now made to FIGS. 3 and 4, which show preferred embodiments of the present invention to reduce the blade load on the detoning roll ends. Changing the free extension length (L) of the blade at the ends of the detoning roll is one way to reduce the blade load. When the scraper blade extension length (L) increases, the force required at the ends to deflect the blade extension is reduced. The free extension length of the blade can be changed by using a "crowned" blade holder 145 (or 155, see FIG. 1), as shown in FIG. 3. The blade load can also be reduced by deflecting the blade using a crowned blade 140 (or 150, see FIG. 1), as shown in FIG. 4. The reduced load at the ends of the detoning roll will increase the overall life of the detoning roll.

The present invention describes a detoning roll scraper blade holder (FIG. 3) or scraper blade (FIG. 4) "crowned" in the center (ends achieved at the center where sufficient toner can lubricate the blade edge without overloading the blade ends where toner collection is generally minimal. The present invention increases blade life and reduces detone roll wear without reducing cleaning performance. The "crowned" portion of the blade or blade holder is angled away from the position of the detoning roll at an angle $\Theta$, of about ten degrees or less from the tangent line 40 to the blade cut away surface 51 or blade holder cut away surface 50. The angling of the blade and the blade holder occur, on each end, approximately 40 mm from the edge. The blade width overall is about 380 mm for "long edge feed" and 240 mm for "short edge feed" (A "short edge feed" is when 8½ in.×14 in. paper is fed into the copier by it's 8½ in. edge where the typical process width is 9 in. to avoid edge effects. A "long edge feed" is where the paper is fed in by it's 14 in. edge.) The blade edge holder is approximately 390 mm for long edge feed and 250 mm for short edge feed.

The embodiments shown and discussed above refer to a scraper blade and a detoning roll. However, the present invention can also be applied to a cleaning blade and a photoreceptive surface to reduce end wear of the photoreceptive drum or belt.

In recapitulation, the uniform load on the scraper blade is prevented from wearing down the detoning roll edges before the middle due to unequal toner distribution. The present invention prevents premature wear of the detoning roll ends where there is less distribution of toner. To prevent wearing of the detoning roll edges, the ends of either the scraper blade or the scraper blade holder are angled away from the detoning roll. The present invention describes a detoning roll scraper blade holder (FIG. 3) or scraper blade (FIG. 4) "crowned" in the center (ends are cut away). With the center "crowned", the desirable working load can be achieved at the center where sufficient toner can lubricate the blade edge without overloading the blade ends where toner collection is generally minimal. The present invention increases blade life and reduces detone roll wear without reducing cleaning performance. The present invention is also applicable to cleaning blades used on photoreceptive surfaces.

It is, therefore, apparent that there has been provided in accordance with the present invention, a cleaning apparatus that provides uniform wear on a surface that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for removing particles from a surface, comprising:

a blade having a free end in contact with the surface and a fixed end opposite said free end, said free end having an edge for cleaning, said free end applying a non-uniform normal force on the surface which compensates for a non-uniform coefficient of friction across the surface to produce a substantial uniform frictional force on the surface preventing non-uniform wear along the surface; and a blade holder coupled to the fixed end of said blade, said blade holder having a crown to create an angle $\Theta$ on each of two sides of said blade holder to reduce the load applied by said blade on the surface in crowned regions.

2. An apparatus as recited in claim 1, wherein the angle $\Theta$ is an angle between a tangent to a surface of said blade holder, on the end coupled to said blade, and a portion of one of the regions of said blade holder forming the angle $\Theta$.

3. An apparatus as recited in claim 2, wherein the angle $\Theta$ is equal to or less than ten degrees.

4. An apparatus for removing particles from a surface, comprising:

a blade having a free end in contact with the surface and a fixed end opposite said free end, said free end having an edge for cleaning, said free end applying a non-uniform normal force on the surface which compensates for a non-uniform coefficient of friction across the surface to produce a substantial uniform frictional force on the surface preventing non-uniform wear along the surface; and a blade holder coupled to the fixed end of said blade, said blade having a crown forming an angle $\Theta$ on each of two sides of said blade to reduce the load applied by said blade on the surface in crowned regions.

5. An apparatus as recited in claim 4, wherein the angle $\Theta$ is an angle between a tangent to the edge of the free end of said blade and a portion of one of the regions of the free end forming the angle $\Theta$.

6. An apparatus as recited in claim 5, wherein the angle $\Theta$ is equal to or less than ten degrees.

7. An apparatus for removing particles from a surface, comprising:

a housing defining an open ended chamber;

a brush, disposed in the chamber of said housing with a portion of the brush extending outwardly from the open end of the chamber of said housing into engagement with the surface to remove particles therefrom;

a detoning roll, rotatably mounted in said housing, for removing particles from said brush;

a scraper blade having a free end in contact with said detoning roll and a fixed end opposite the free end, said scraper blade applying a non-uniform normal force on said detoning roll which compensates for a non-uniform coefficient of friction across said detoning roll to produce a substantial uniform frictional force on said detoning roll preventing non-uniform wear along said detoning roll; and a scraper blade holder coupled to said housing on one end and coupled to the fixed end of said scraper blade on another end of said scraper blade holder, the free end of said scraper blade contacting said detoning roll, said scraper blade holder having a crown to create an angle $\Theta$ on each of two sides of said scraper blade holder to reduce the load applied by said scraper blade on the surface in crowned regions.

8. An apparatus as recited in claim 7, wherein the angle $\Theta$ is an angle between a tangent to a surface of said scraper blade holder, on the end coupled to said scraper blade, and a portion of one of the regions of said scraper blade holder forming the angle $\Theta$.

9. An apparatus as recited in claim 8, wherein the angle $\Theta$ is equal to or less than ten degrees.

10. An apparatus as recited in claim 9, wherein said scraper blade includes a crown forming an angle $\Theta$ on each of two sides of said scraper blade to reduce the load applied by said scraper blade on the surface in crowned regions.

11. An apparatus as recited in claim 10, wherein the angle $\Theta$ is an angle between a tangent to the edge of the free end of said scraper blade and a portion of one of the regions of the free end of said scraper blade forming the angle $\Theta$.

12. An apparatus as recited in claim 11, wherein the angle $\Theta$ is equal to or less than ten degrees.

13. A method for removing particles from a surface, comprising:

cleaning particles from the surface having a brush contacting the surface;

detoning said brush having a detoning roll to remove particles from said brush;

removing particles from said detoning roll with a scraper blade having a free end in contact with said detoning roll;

supporting said scraper blade in a scraper blade holder; and applying a non-uniform normal force on said detoning roll, using a crowned scraper blade holder, which compensates for a non-uniform coefficient of friction across said detoning roll to produce a substantial uniform frictional force on said detoning roll preventing non-uniform wear along said detoning roll.

14. A method for removing particles from a surface, comprising:

cleaning particles from the surface having a brush contacting the surface;

detoning said brush having a detoning roll remove particles from said brush;

removing particles from said detoning roll with a scraper blade having a free end in contact with said detoning roll;

supporting said scraper blade in a scraper blade holder; and applying a non-uniform normal force on said detoning roll, using a crowned scraper blade, which compensates for a non-uniform coefficient of friction across said detoning roll to produce a substantial uniform frictional force on said detoning roll preventing non-uniform wear along said detoning roll.

* * * * *